United States Patent [19]

Hiller

[11] Patent Number: 4,982,539

[45] Date of Patent: Jan. 8, 1991

[54] GRID GIRDER FOR RAISED FLOORS

[75] Inventor: Wolfgang Hiller, Laudenbach, Fed. Rep. of Germany

[73] Assignee: Mero-Werke, Fed. Rep. of Germany

[21] Appl. No.: 417,052

[22] Filed: Oct. 4, 1989

[30] Foreign Application Priority Data

Oct. 5, 1988 [DE] Fed. Rep. of Germany ..... 3833875

[51] Int. Cl.[5] ..... E04B 5/43

[52] U.S. Cl. ..... 52/263; 52/126.6

[58] Field of Search ..... 52/695, 263, 126.6

[56] References Cited

U.S. PATENT DOCUMENTS

| | | | |
|---|---|---|---|
| 2,467,558 | 4/1949 | Kapnek | 52/695 |
| 2,623,246 | 12/1952 | Pestak | 52/695 |
| 3,102,306 | 9/1963 | Hutchinson | 52/695 |
| 3,616,584 | 11/1971 | Sartori | 52/126.6 |
| 4,085,557 | 4/1978 | Tharp | 52/126.6 |
| 4,277,923 | 7/1981 | Rebentisch | 52/126.6 |
| 4,685,258 | 8/1987 | Av-Zuk | 52/126.6 |

*Primary Examiner*—John E. Murtagh

*Attorney, Agent, or Firm*—Frank P. Presta

[57] ABSTRACT

It is known to lay out the floorboards of raised floors on grid girders, which are attached to the cover plates of legs of the raised floor. The grid girders are either inserted into suitable recesses in the cover plates where they may be made secure in these recesses by means of tongues which engage in boreholes in the cover plates, or else under more stringent specifications they are screwed into the reinforcement of the raised floor with the cover plates. Until this time, for the two variations of assembly, two different types of girders have also been produced. Both variations of assembly can be attained by use of the grid girder according to the present invention. For this purpose, the side walls of the grid girder are provided with beveled ends in such a manner that the grid girder, when viewed from the side, has the shape of a parallelogram. At the ends of both of the other walls of the grid girder are provided in turn tongues or oblong apertures for the passage of fastening screws. Tongues are intended for the loose engagement of the grid girder in the boreholes of cover plates, while with the other variation of assembly the fastening screws are fed through oblong apertures and are twisted or tapped into the boreholes.

4 Claims, 2 Drawing Sheets

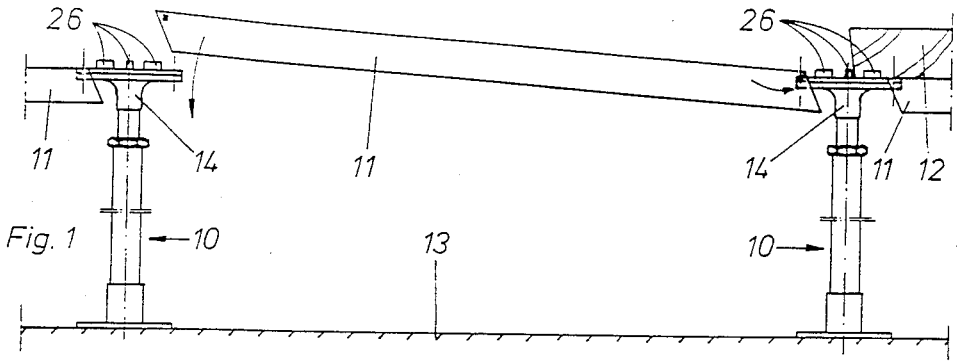
Fig. 1
Fig. 2
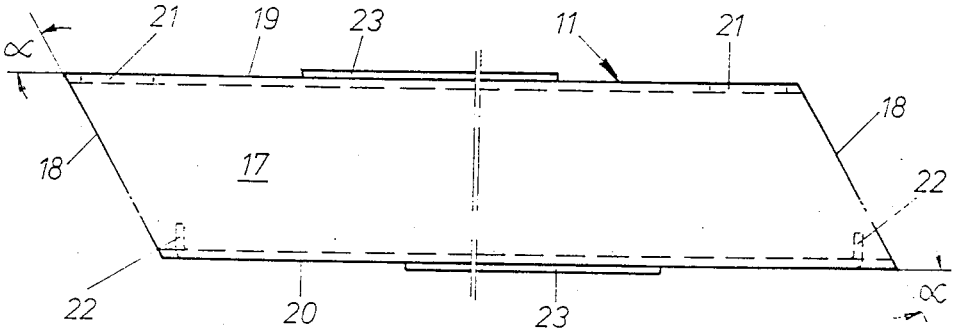
Fig. 3
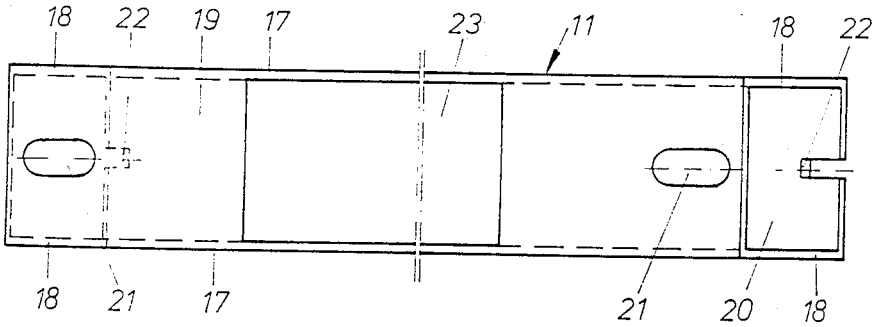

GRID GIRDER FOR RAISED FLOORS

BACKGROUND OF THE INVENTION

The invention relates to a grid girder for raised floors, comprising legs which incorporate cover plates for connection and attachment of the grid girders which are manufactured of square pipes, as well as floorboards or tiles laid out on the grid girders, and the cover plates of the legs are provided with pairs of recesses arranged around their peripheries in the form of a cross and boreholes to receive either the grid girder ends or else tongues, taper plugs or fastening screws mounted on the ends of the grid girders.

In order to strengthen the supporting substructure of raised floors, it is known to mount grid girders between the cover plates of the legs, on which the floorboards or tiles are then laid out. The cover plates of the legs for this purpose have pairs of recesses arranged in a cross-like configuration around their periphery, into which the side walls are inserted from above at the ends of each grid girder. One of the two other walls of the grid girder is provided with corresponding recesses at its ends, in order to facilitate the introduction of the ends of the side walls of the grid girder into the recesses in the cover plates of the legs. On the wall-end segments of the grid girders lying opposite and facing these recesses are provided inward projecting tongues, with one type of girder, and boreholes, with another type of girder, instead of these tongues, and the boreholes are arranged for the introduction of fastening screws. The grid girders with tongues at their ends are inserted practically speaking loosely into the supporting substructure, while the other grid girder type is screwed into the cover plates of the legs. In the just cited case the supporting substructure obtains a further improved reinforcement. The two different reinforcement modifications which have been applied to the supporting substructure of the raised floor until this time however, have required the production and warehousing of two different types of grid girders, which is a practical disadvantage. It then happens that sharp edges are present on the elements, as a result of the aforementioned recesses in the ends of the grid girder, which with the assembly of raised floors and also with subsequent installation procedures form a danger of injury to the assemblers.

SUMMARY OF THE INVENTION

The object of the invention is to overcome the above problems and to disclose a grid girder for raised floors which can be inserted as desired either loosely into or even screwed securely into the supporting substructure of the raised floors.

The invention overcomes the above problems with a solution wherein (a) the grid girder has its side walls with their ends beveled in such a manner that, when seen from the side, the girder has the shape of a parallelogram, and (b) each of the two other opposite and facing walls of the grid girder includes tongues, taper plugs or the like, or else boreholes, for instance in the form of oblong apertures, for the passage of fastening screws.

Such a grid girder, according to its selected type of assembly, can advantageously either be inserted loosely into the supporting substructure or even be screwed securely together with this substructure. Therefore one and the same grid girder type according to the invention can be used for both of the variations of assembly, whereupon the manufacture and warehousing of these girders is simplified. If following completion of the assembly of the grid girders it is then proven that the raised floor or its supporting substructure for instance must be reinforced more intensely in certain areas, the grid girders need simply be twisted or swiveled around in the respective portion of the floor and be screwed together with the respective cover plates on the legs. The exchange of grid girders required until this time in such situations is no longer necessary. A further advantage of the grid girder according to the invention resides in that it has no sharp-edged ends, which could incur the danger of injury to workers. The selected arrangement of the grid girder in one or the other position in the assembly of the supporting substructure of the raised floor is allowed for in that in any position in the assembly the beveled side walls of the grid girder can be introduced into the recesses on the cover plates of the previously assembled legs. Thus either the tongues or taper plugs or the like are brought into contact with the boreholes in the cover plates of the legs or else the fastening screws being inserted through the boreholes in the girder ends are screwed into the boreholes in the cover plates. Self-tapping screws are used for this purpose.

Other configurations of the invention arise from the dependent claims. Thus, in one preferred embodiment, the ends of the side walls of the grid girder are beveled relative to both other girder walls at an angle of approximately 60°.

Still another configuration of the invention is characterized in that on both other walls which are facing each other the same as the side walls of the grid girder are provided height compensation layers of for instance plastic or cork strips for the compensation of supporting gaskets or the like incorporated into the cover plates of the legs. This is how the sufficient support of the floorboards which is required is attained over practically the entire length of the grid girder. The grid girders are thus also fixed when they are in "loosely inserted state". The supporting gaskets, which are generally of plastic, serve in a known manner as fixing accessories for the floorboards as well as for sound insulation.

BRIEF DESCRIPTION OF THE DRAWINGS

The invention is to be explained hereinafter relative to the drawing of one exemplary embodiment. In the drawing:

FIG. 1 is a cross sectional view through a part of a raised floor including a grid of girders according to the invention, of which one grid girder is shown in the assembly phase;

FIG. 2 is a side view of a grid girder shown in FIG. 1 in enlarged scale;

FIG. 3 is a plan view of the grid girder of FIG. 2;

DESCRIPTION OF THE PREFERRED EMBODIMENTS

Figure 4:
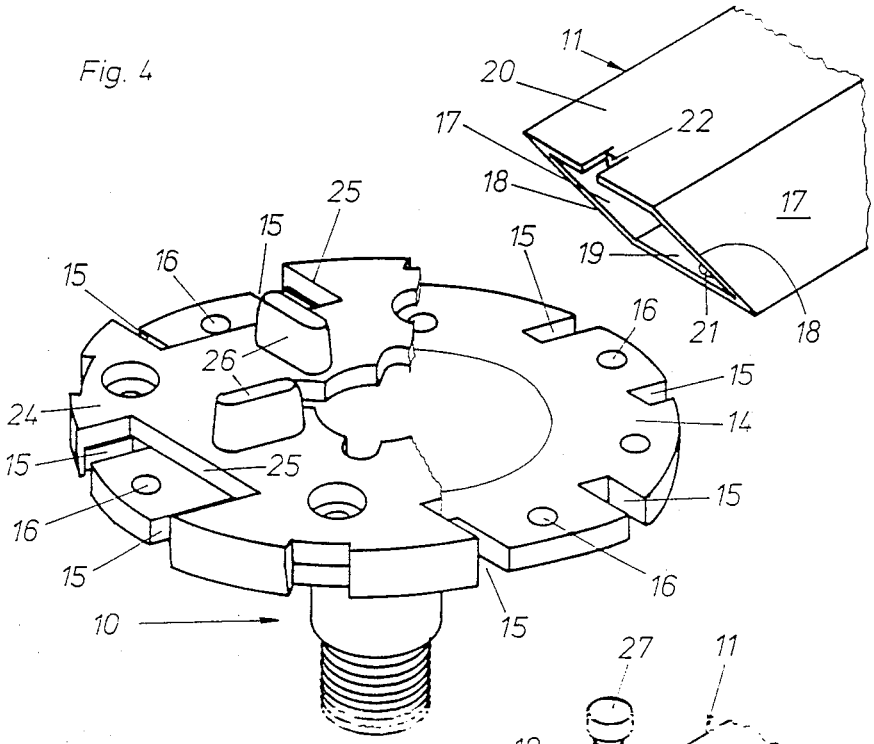
FIG. 4 is an oblique view of a part of one leg of the raised floor shown in FIG. 1 with a part of a grid girder.

The raised floor shown partially in FIG. 1 is to be made up of height adjustable legs 10, grid girders 11 and quadratic flooring members 12. At the beginning of the assembly of the raised floor, legs 10 are fastened to the bottom flooring 13 of the respective building space. Each leg 10 incorporates a cover plate 14, at the periphery of which are carved pairs of recesses 15 arranged in the form of a cross, which open outward. Aligned midline between each two recesses 15 is a borehole 16.

The legs 10 together with the grid girders 11 form the supporting substructure for floorboards 12, which are mounted on grid girders 11. Grid girders 11 are configured identically and now one of them is to be described in the following in its physical embodiment with reference to FIGS. 2 and 3.

Grid girder 11 is produced of a rectangular pipe and both of its side walls 17 have beveled ends 18 and all of the dimensional lines are parallel to their respective opposite lines. Viewed from the side, therefore, grid girder 11 has the shape of a parallelogram (FIG. 2). The angle of inclination of the ends 18 of the side walls 17 relative to both of the other girder walls 19 and 20 may be 60°.

Figure 5:
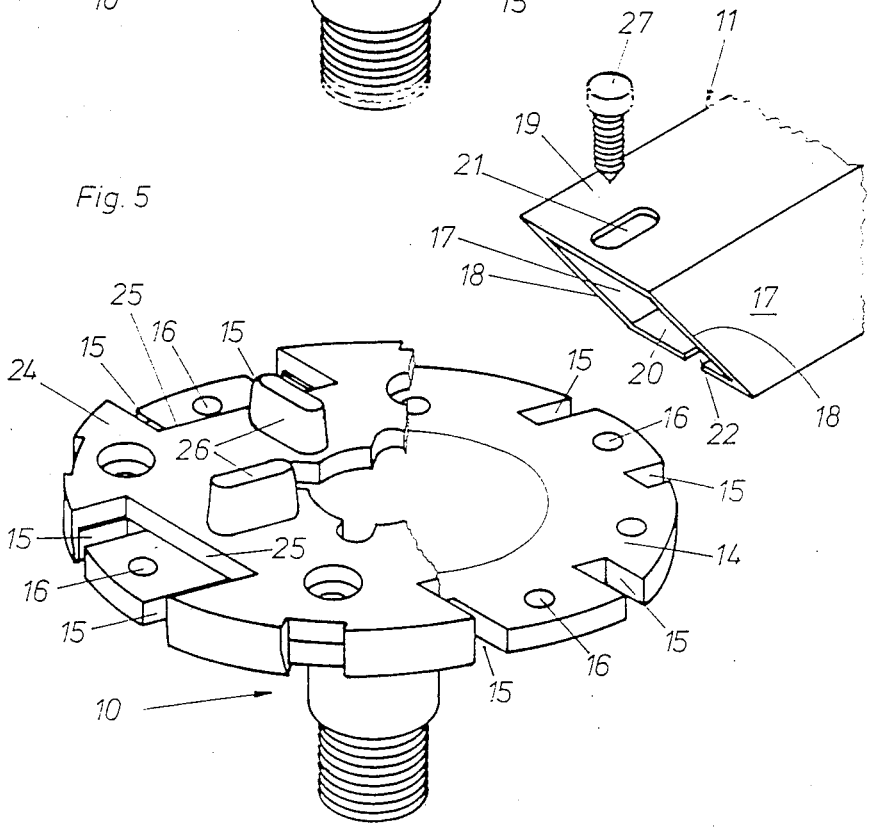
FIG. 5 is an oblique view similar to that of FIG. 4, which however shows the grid girder turned over in the assembly so that it can be screwed together with the leg.

On wall 19 of grid girder 11 wherein the wall is at the top in FIGS. 2 and 3, oblong apertures 21 are carved out in the ends which are opposite one another in the arrangement, for the insertion of fastening screws 27 (FIG. 5). On the ends of the wall 20 of grid girder 11 lying at the bottom in FIGS. 2 and 3 are stamped out tongues 22 which are then bent inward at a right angle. To the outsides of these walls 19 and 20 of grid girder 11 are fastened height compensation layers 23, for instance strips of plastic or cork, of which the purpose is to be explained hereinafter.

Grid girders 11 could be arranged with their wall either 19 or 20 pointing upward when connected with legs 10. In any case the beveled ends 18 of side walls 17 of grid girder 11 are thus inserted from the side and from above into the corresponding pairs of recesses 15 on two facing legs 10, as is indicated in FIG. 1 by the arrows. Thus, as shown in FIG. 4, tongues 22 are brought into engagement with the boreholes 16 between the corresponding pairs of recesses 15. When this is done, grid girders 11 are connected loosely with the cover plates 14 of legs 10. In the other variation of assembly, wall 19 is located at the top and the oblong apertures 21 overlap the corresponding boreholes 16 between the legs 10 and adjacent to pairs of recesses 15. In this case, grid girders 11 are connected with cover plates 14 of the legs 10 adjacent to the respective girder by means of fastening screws 27, which are introduced through oblong apertures 21 and can be screwed into boreholes 16 in cover plates 14. Self-tapping screws are used for this purpose.

When in the above manner grid girders 11 have been loosely connected or securely screwed together with legs 10, the floorboards 12 can be mounted upon the grid girders 11. Beforehand however support gaskets 24 are arranged on cover plates 14 of legs 10, and the gaskets include open cutouts 25 arranged in cross shape, in order to expose the pairs of recesses 15 upward, so that grid girders 11, as described above, can be fastened to cover plates 14. Support gaskets 24 carry four symmetrically arranged stops 26 on their top, which form auxiliary positioning members for laying on of floorboards 12. Supporting gaskets 24 are plastic and also provide sound insulation. The thickness of the material of supporting gaskets 24 corresponds to the wall thickness of grid girders 11 with the addition of a few of the height compensation layers 23. Thus it is guaranteed that floorboards 12 engage satisfactorily on grid girders 11 over practically the entire length of the grid girders.

Instead of having the tongues 22 stamped out of the grid girder material and bent downward, taper plugs, somewhat in the form of welded-on bolts, or else some other similar members, could also be provided.

What is claimed is:

1. Grid girder assembly for raised floors, comprising legs which incorporate cover plates for connection to the grid girders which are of substantially rectangular construction for the support of floorboards laid on the grid girders, and the cover plates of the legs are provided on their periphery with pairs of recesses and boreholes therebetween to receive the ends of the grid girders, characterized in that (a) the grid girder (11) has side walls (17) with ends (18) which are beveled in such a manner that, when viewed from the side, the girder has the shape of a parallelogram, and (b) the grid girder (11) has upper and lower walls (19, 20) lying opposite and facing one another, the upper wall (19) of the grid girder having oblong apertures (21) at both ends thereof for the passage of fastening screws therethrough and into the boreholes on the cover plates to secure the grid girder thereto, and the lower wall (20) of the grid girder having inwardly extending tongues (22) at both ends thereof of a size to be received within the boreholes on the cover plates.

2. Grid girder assembly as in claim 1, characterized in that the ends (18) of the walls (17) of the grid girder (11) are beveled relative to both of the other girder walls (19, 20) at an angle of approximately 60 degrees.

3. Grid girder assembly as in claim 1 characterized in that on both of the upper and lower walls (19, 20) there are provided height compensation layers (23) to compensate for supporting gaskets (24) on the cover plates (14) of the legs (10).

4. Grid girder assembly as in claim 2 characterized in that on both of the upper and lower walls (19, 20) there are provided height compensation layers (23) to compensate for supporting gaskets (24) on the cover plates (14) of the legs (10).

* * * * *